US005949376A

United States Patent [19]

McDonald et al.

[11] Patent Number: 5,949,376

[45] Date of Patent: Sep. 7, 1999

[54] DUAL POLARIZATION PATCH ANTENNA

[75] Inventors: Noel A. McDonald, Croydon, Australia; Shaun Hamilton, Tamasek Green, Singapore

[73] Assignee: Alcatel Alsthom Compagnie Generale d'Electricite, Paris, France

[21] Appl. No.: 09/102,219

[22] Filed: Jun. 22, 1998

[30] Foreign Application Priority Data

| | | | |
|---|---|---|---|
| Jul. 29, 1997 | [AU] | Australia | PO 8289 |
| Sep. 8, 1997 | [AU] | Australia | PO 9013 |
| Feb. 9, 1998 | [AU] | Australia | PP 1711 |

[51] Int. Cl.[6] ..... H01Q 1/38

[52] U.S. Cl. ..... 343/700 MS; 343/829; 343/848

[58] Field of Search ..... 343/700 MS, 846, 343/848, 829, 830, 767, 770; H01Q 1/38

[56] References Cited

U.S. PATENT DOCUMENTS 5,241,321 8/1993 Tsao ..... 343/700 MS 5,668,558 9/1997 Hong ..... 343/700 MS

*Primary Examiner*—Don Wong

*Assistant Examiner*—Tho Phan

*Attorney, Agent, or Firm*—Ware, Fressola, Van Der Sluys & Adolphson LLP

[57] ABSTRACT

The antenna element comprises a printed circuit board (1) on one side of which is a conductive ground plane (2); and on the other side of which are two symmetrical conductive feed tracks (3,4) which excite orthogonal slot apertures (12,13, 22, 23) etched in the ground plane. Radiation from the slots induces orthogonal currents into a radiating patch (14, 18) supported in a spaced relationship with the slots. Two signals can be radiated from the patch simultaneously with 90° separation in polarization. The slots radiate to the rear as well as to the front. A symmetrical conductive cavity (17, 25) enclosing the slots contains rear radiation.

28 Claims, 9 Drawing Sheets

DUAL POLARIZATION PATCH ANTENNA

BACKGROUND OF THE INVENTION

1. Technical Field

This invention relates to electromagnetic radiation antenna structures capable of receiving and transmitting radio signals that may include dual orthogonally polarized components.

2. Discussion of Related Art

In a complex urban environment of buildings, structures and obstacles, a radio signal will be reflected and scattered and may not follow a straight line path between a transmitter and receiver. Polarization rotation of the radio signal may occur due to reflection and scattering.

To overcome the effects of polarization rotation, polarization diversity reception is known to be used. Polarization diversity requires an antenna to be able to receive components of a signal of any polarization, both horizontally polarized and vertically polarized signals or any polarization between.

A typical cellular mobile radio base station antenna tower will have one transmit antenna and two receive antennas in a "space diversity" configuration for any sector. The receive antennas are spaced apart with the transmit antenna placed between them. One receive antenna will be in a zone of increased signal strength relative to the other receive antenna, should multi-path scattering effects occur. This arrangement typically requires a complex infrastructure, as three antennas are used in each sector, usually nine to a tower. Such known antenna arrangements are relatively large, expensive and visually unappealing.

SUMMARY OF THE INVENTION

It is an object of the present invention to provide an easily manufactured antenna element for use in a relatively small, lightweight, visually more appealing dual polarization antenna array of simple construction having good bandwidth and polarization isolation.

According to a first aspect of the invention there is provided an antenna element for transmitting and/or receiving radio frequency signals that may include dual orthogonally polarized components, said antenna element comprising a planar dielectric element supporting on one side thereof a conductive ground plane element and on an opposite side thereof two substantially identical conductive feed track arrays disposed at right angles to each other and each being electrically symmetric about a bisecting plane, said ground plane element having two substantially identical slot aperture arrangements each comprising at least one elongate slot of predetermined length, said aperture arrangements' longitudinal axes being disposed at right angles to each other and cross at their respective mid-points, each slot aperture arrangement being symmetrical about a respective bisecting plane bisecting a feed track array, a symmetrical conductive patch element disposed in a predetermined spaced relationship with said slot aperture arrangement and above said opposite side of said planar dielectric element, and a symmetrical conductive cavity element comprising a bottom wall portion and at least one side wall portion having a rim, disposed on said ground plane element and electrically coupled thereto, said cavity element enclosing said elongate slot aperture arrangement within the said wall portions and a surface portion of said ground plane element that is proximate said slot aperture arrangement.

According to a second aspect of the invention, there is provided an antenna element for transmitting and/or receiving radio frequency signals that may include dual orthogonally polarized components, said antenna element comprising a planar dielectric element supporting on one side thereof a first conductive ground plane element and on an opposite side thereof two substantially identical conductive feed track arrays disposed at right angles to each other and each being electrically symmetric about a bisecting plane, said ground plane element having two substantially identical slot aperture arrangements of predetermined length, said aperture arrangements' longitudinal axes being disposed at right angles to each other and cross at their respective mid-points, each slot aperture arrangement being symmetrical about a respective bisecting plane bisecting a feed track array, a symmetrical conductive patch element disposed in a predetermined spaced relationship with said slot aperture arrangement and above said opposite side of said planar dielectric element, a second conductive ground plane supported in a predetermined spaced relationship with said first conductive ground plane, and a symmetrical conductive cavity element comprising a bottom wall portion and at least one side wall portion having a rim, said cavity element being interposed between said first conductive ground plane and said second conductive ground plane, said bottom wall portion electrically contacting said second conductive ground plane and said rim being capacitively coupled to said first conductive ground plane, said cavity element enclosing said elongate slot aperture arrangement within the said wall portions and a surface portion of said ground plane element that is proximate said slot aperture arrangement.

According to a third aspect of the invention, there is provided an antenna array comprising a plurality of antenna elements of the present invention operatively coupled together.

BRIEF DESCRIPTION OF THE INVENTION

In order that the invention may be readily carried into effect, embodiments thereof will now be described in relation to the accompanying drawings, in which.

DETAILED DESCRIPTION OF PREFERRED EMBODIMENTS

Figure 1:
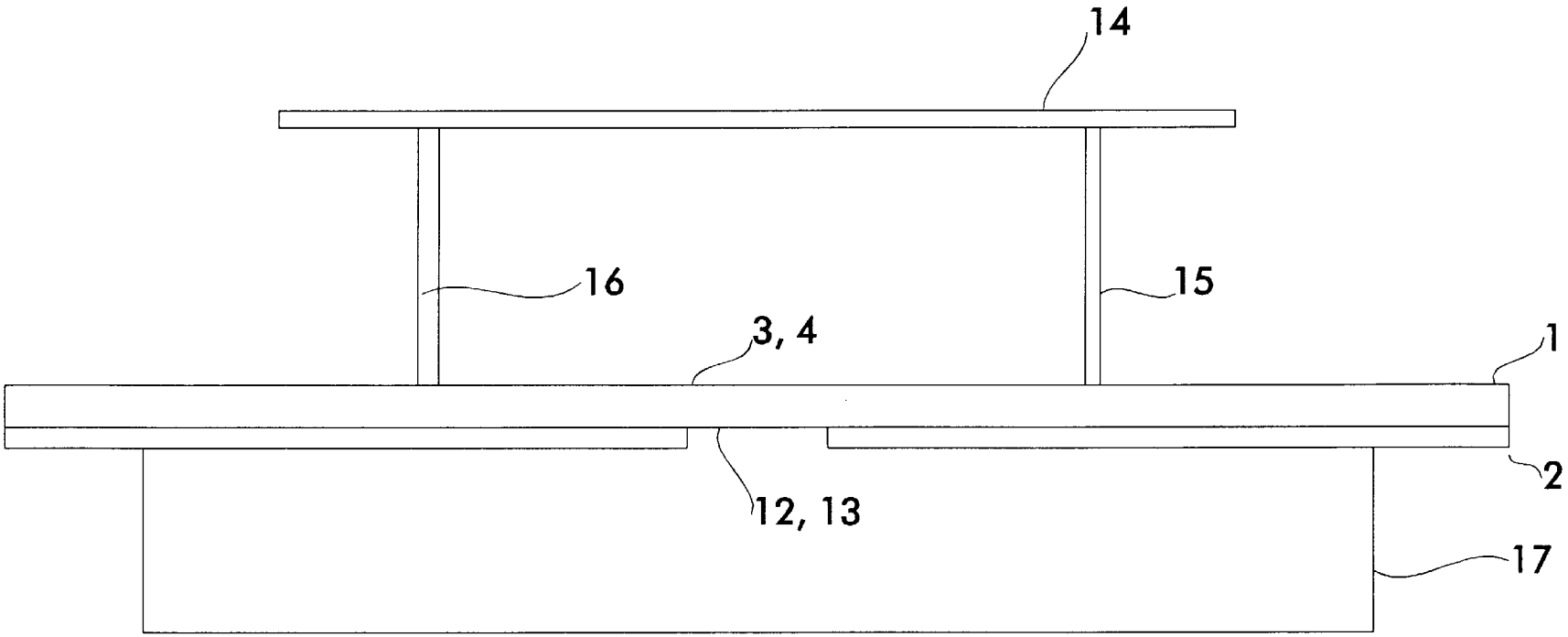
FIG. 1 shows a side view of a first embodiment of the antenna element.
Figure 2:
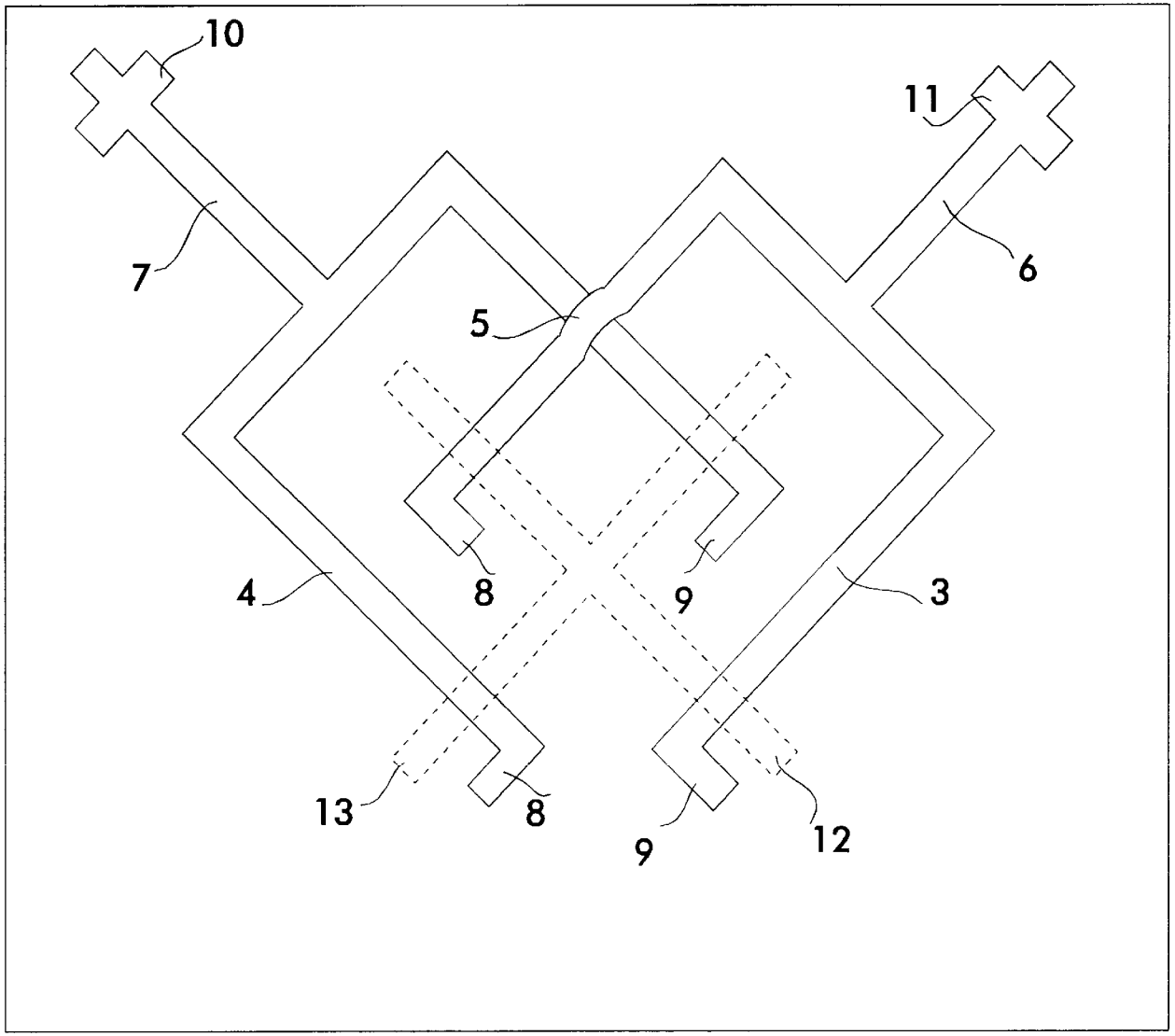
FIG. 2 shows a top view of the element shown in FIG. 1 without the radiating patch.
Figure 3:
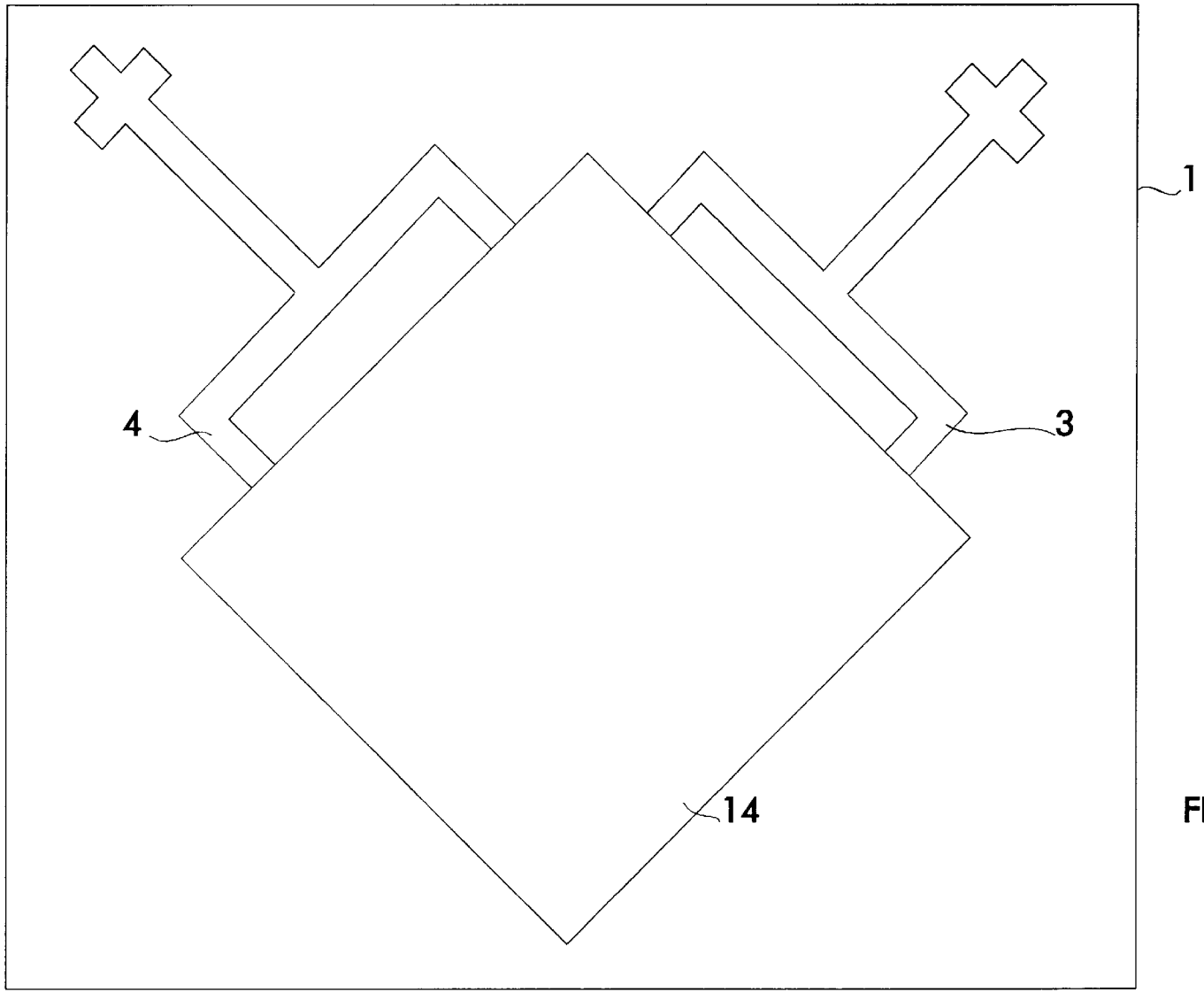
FIG. 3 shows a top view of the element shown in FIG. 1 with the radiating patch.
Figure 4:
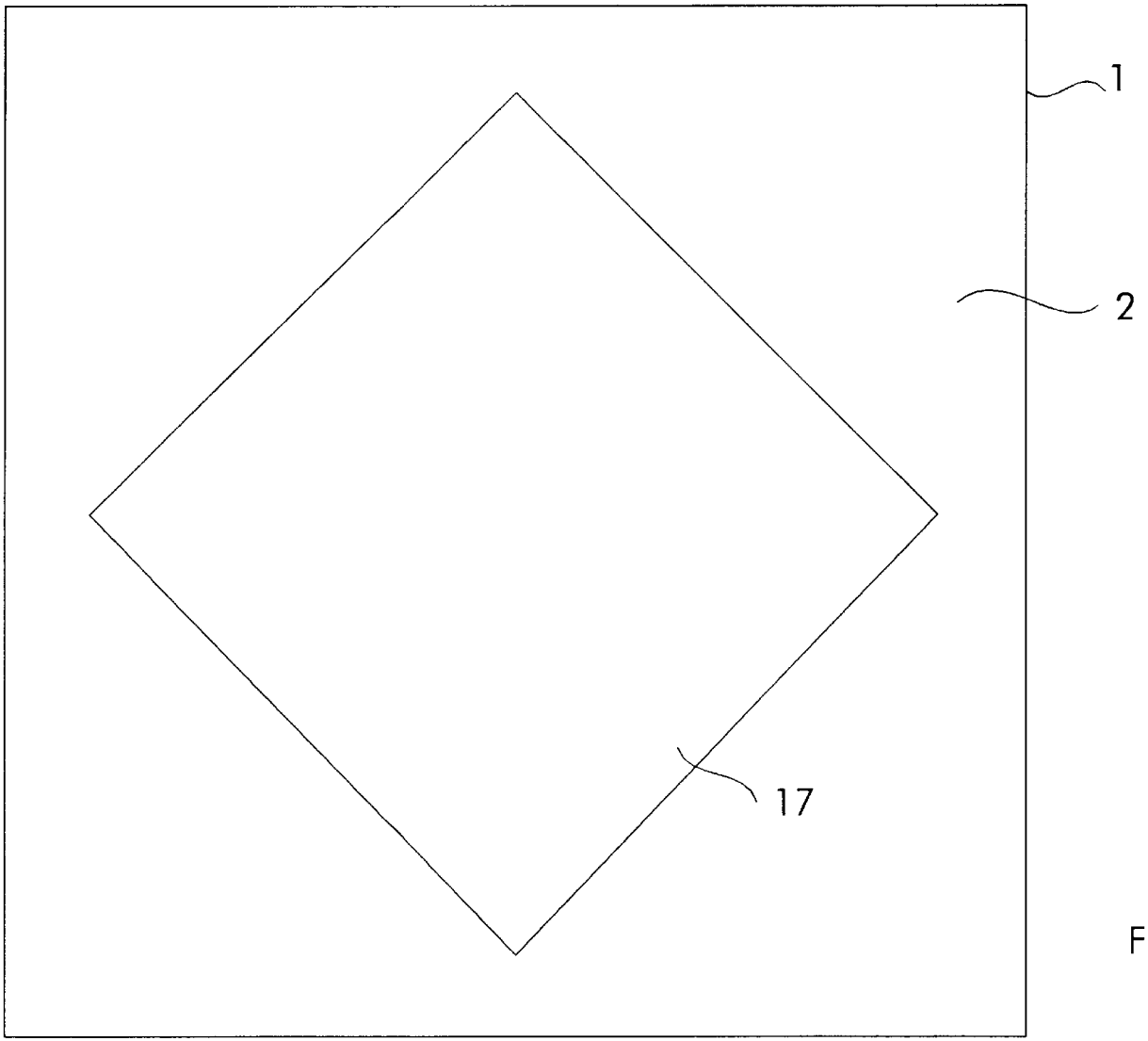
FIG. 4 shows a bottom view of the antenna element shown in FIG. 1.

Referring to FIGS. 1–4, the antenna element comprises a printed circuit board, 1, on one side of which is a conductive ground plane 2, and on the other side of which are two symmetrical U-shaped conducting feed track arrays 3, 4 disposed at right angles to each other, each being electrically symmetric about a bisecting plane. An air bridge 5, is provided where feed track 3 crosses feed track 4. Each feed track includes an input means 6, 7, and preferably an open circuit stubs 8, 9, and optional matching tabs 10, 11. Each electrically symmetric feed track array is also physically symmetric except for the air bridge and the bends in the open circuit stubs.

Two orthogonal slot apertures 12, 13, intersecting at their mid-points are etched in the ground plane (2). Each slot aperture is arranged to be symmetrical about a respective bisecting plane bisecting a corresponding feed track array. A conductive radiating patch 14 is fixedly spaced from slot apertures 12, 13 by pillars 15, 16.

A symmetrical conductive cavity 17 is attached to and electrically connected to ground plane 2, such that it encloses slot apertures 12, 13. Alternatively, the symmetrical conductive cavity 17 can be attached in a non-contacting manner to ground plane 2 by means of adhesive tape, preferably of the kind that comprises a mounting tape with adhesive material on two opposite sides, such as, for example, Normount (Reg. Trademark) V2830 high performance mounting tape. One side is adhered to an outwardly extending flange (not shown) provided on the rim of the conductive cavity, and then the conductive cavity is pressed onto the ground plane to which it becomes attached by virtue of the adhesive material on the opposite side of the tape. There is sufficient capacitance through the tape to achieve an equivalent of an electrical connection.

Signals are fed via transmission lines (not shown) to the input means (6,7) of the feed tracl<s. Optional matching tabs (10,11) provide impedance compensation.

The input means is connected to two transmission lines consisting of parallel arms of the U-shaped feed tracks (3,4). The transmission lines extend symmetrically over respective slot apertures (12,13). By having feed tracks on the same side of the printed circuit board as the radiating patch, and opposite the conductive cavity side, the tracks are advantageously accessible for adjustment, and do not require cutouts in the conductive cavity as with some prior art arrangements in which the feed elements of the antenna are located within the conductive cavity.

For maximum coupling of the signal to the radiating aperture slot, maximum signal current should be present in the vicinity of the slot. The open circuit stubs (8,9), approximately $\lambda/4$ long, ensure a current maximum occurs on the transmission lines at the point where they cross over the aperture slots.

The orthogonal aperture slots are excited by the transmission lines. The radiation from the slots then induces orthogonal currents in the patch (14), which induces orthogonal radiation. Two signals can be radiated from the patch simultaneously with 90° separation in polarization. The cross-coupling between the signals is less than −25 dB.

The aperture slots radiate to the rear as well as the front of the printed circuit board. In an array of antenna elements, the radiation from the rear can couple into another array element, degrading the impedance matching characteristics and the radiation pattern. The conducting cavity (17) contains the rear radiation by enclosing the aperture slots on the ground plane side of the printed circuit board. The cavity is preferably symmetric in order to maintain good isolation between the two signals.

Figure 5:
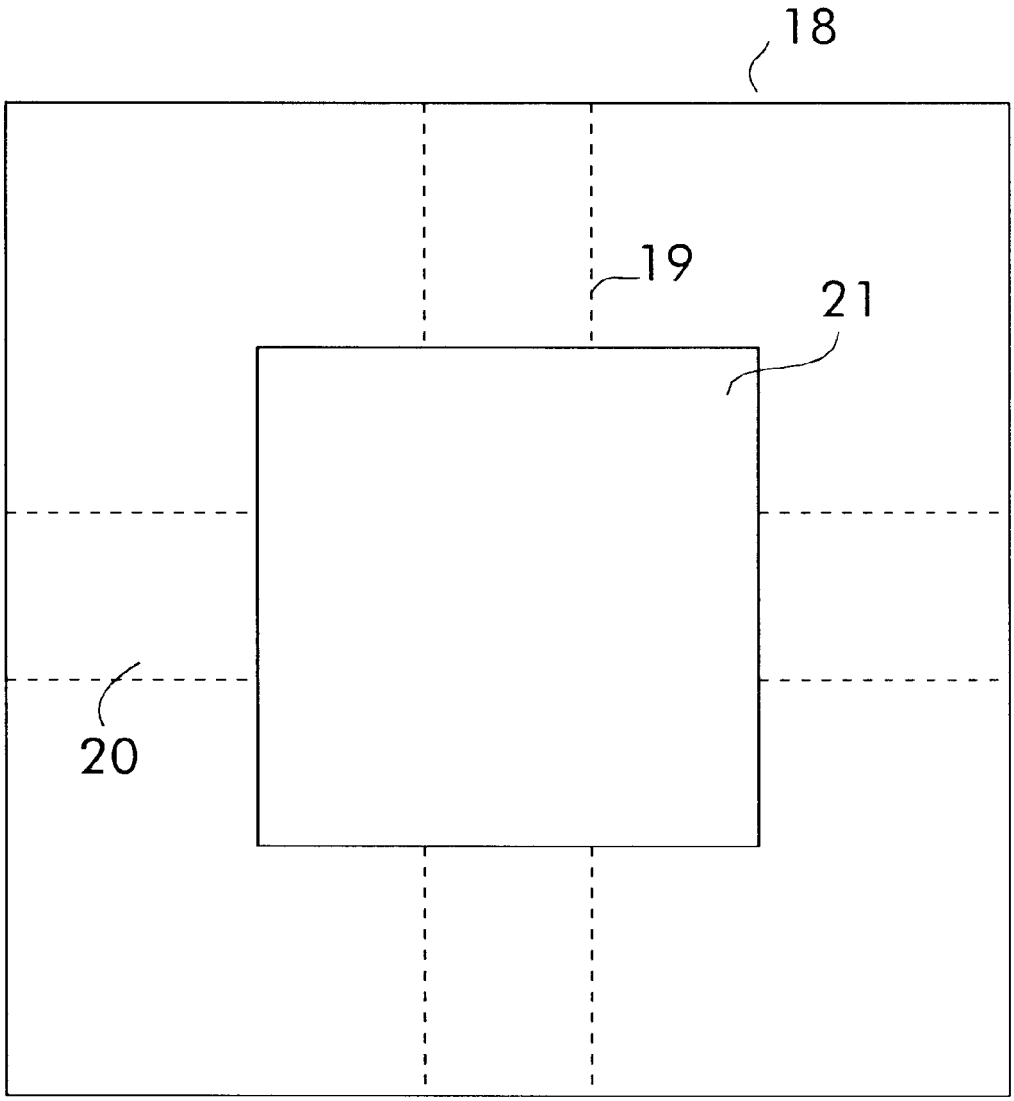
FIG. 5 shows a top view of an alternative radiating patch arrangement.
Figure 6:
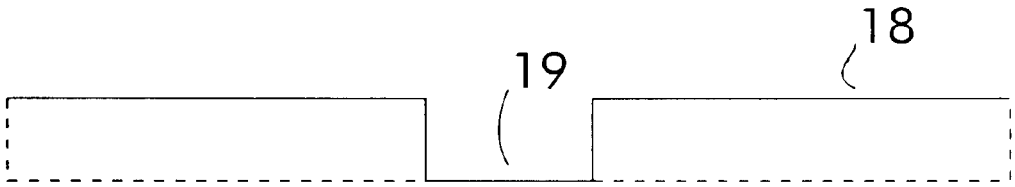
FIG. 6 shows a side view of the radiating patch shown in FIG. 6.

Referring to FIGS. 5 and 6, an alternative radiating patch arrangement comprises a square-shaped conductive plate 18 having two rectangular troughs 19 and 20, whose respective longitudinal axes are mutually perpendicular and intersect at mutual mid-points. The troughs are interrupted by a central square aperture 21. The troughs could be V-shaped, hemicycle, or any other symmetrical shape. The troughs preferably face towards the slot apertures 12,13. The conductive plate 18 and the aperture 21 can be any symmetrical shape. The aperture 21 is optional but can have manufacturing or electrical benefits.

The conducting patch 14,(18) can be implemented by attaching it to a radome, thereby removing the need for pillars 15,16.

The shapes of the aperture slots, cavity, feedlines and patch could be varied to achieve desired results.

Figure 7:
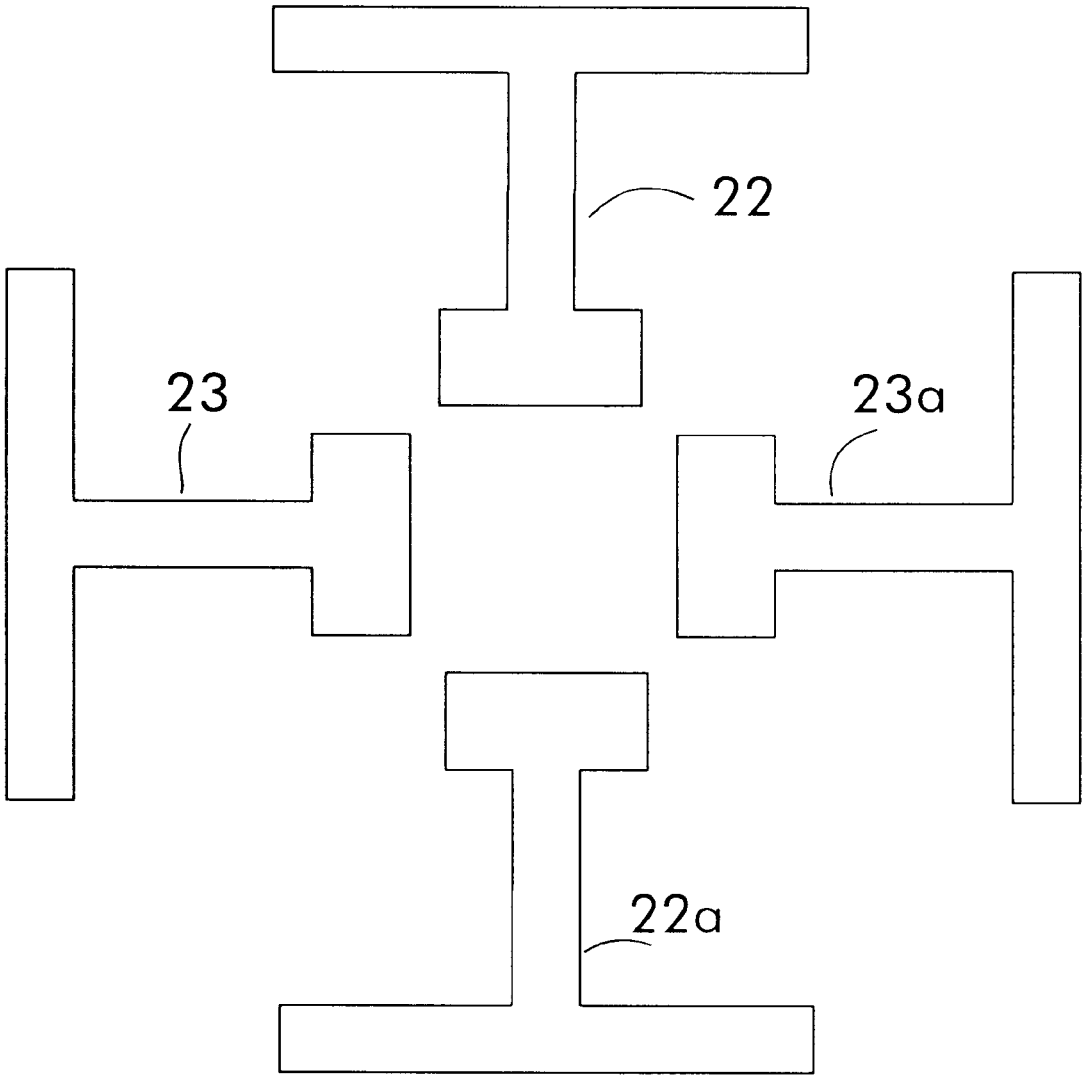
FIG. 7 shows an alternative slot-aperture arrangement.

Referring to FIG. 7, an alternative slot aperture arrangement comprises two pairs of end-loaded slots 22, 22*a* and 23, 23*a*, the common longitudinal axes of each pair of slots being mutually perpendicular and intersecting at mutual mid-points. This slot aperture arrangement is preferably used with the radiating patch described in relation to FIGS. 5 and 6.

Figure 8:
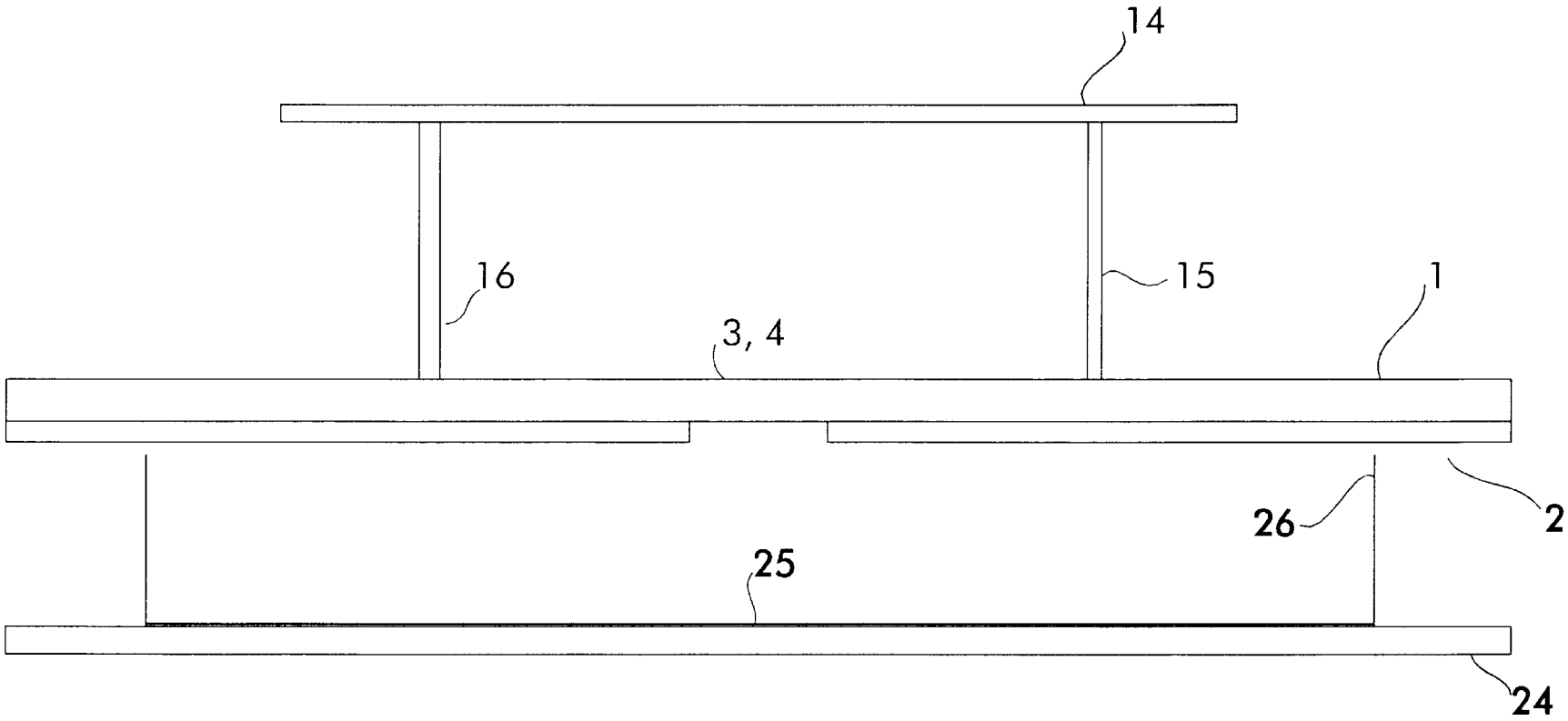
FIG. 8 shows a side view of a second embodiment of the antenna element.
Figure 9:
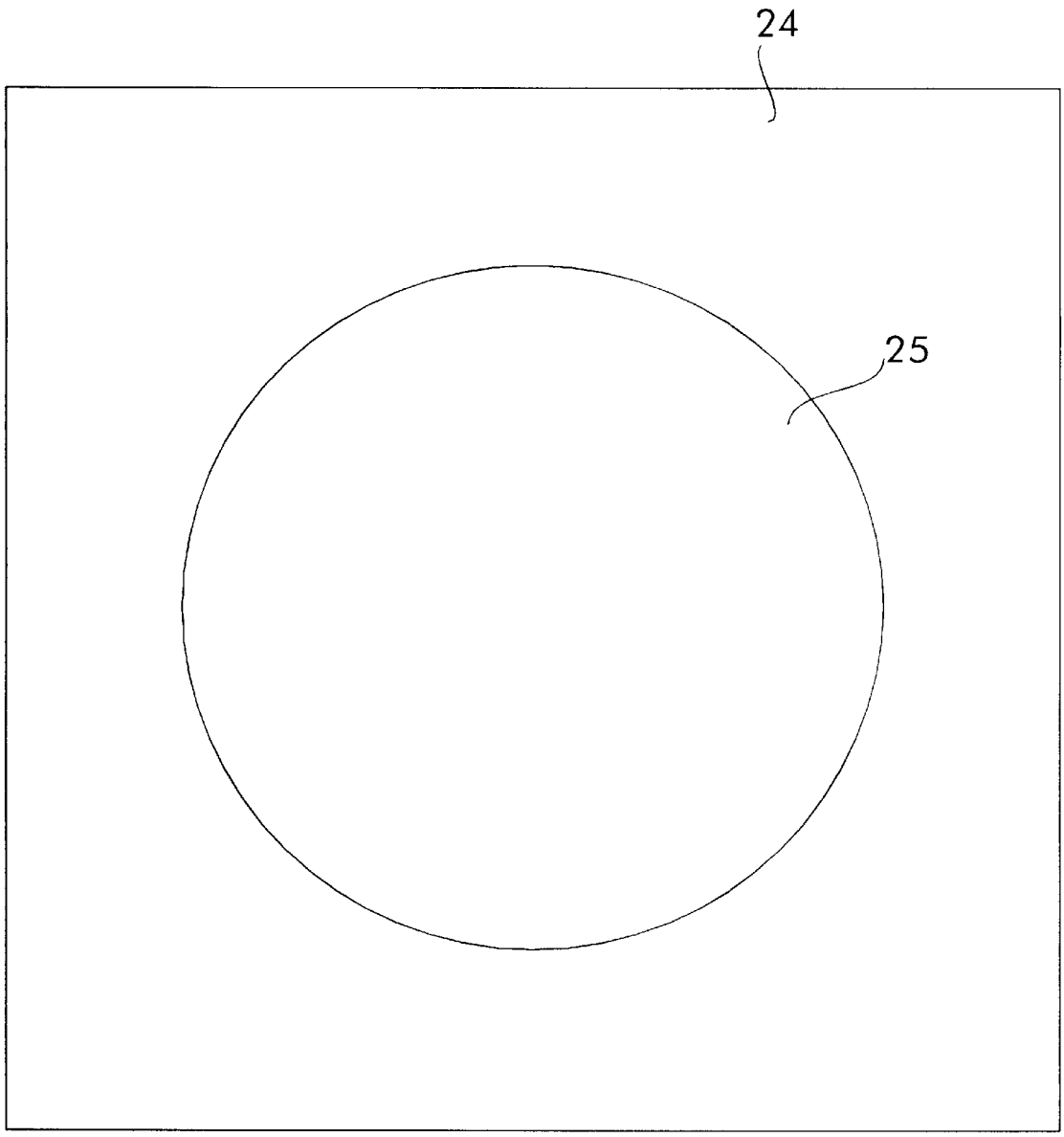
FIG. 9 shows a top view of a dish-shaped conductive cavity supported on a second ground plane.

Referring to FIGS. 8 and 9, a further embodiment of the element comprises a printed circuit board, a first ground plane, feed tracks, slot apertures and radiating patch arranged in the same manner as shown in FIG. 1, except for the conductive cavity. In this embodiment a second ground plane 24 is supported in a spaced relationship with the first ground plane 2. Interposed between the two ground planes is a circular dish shaped conductive cavity 25 whose rim 26 is spaced from the first ground plane 2 and capacitively coupled thereto, and whose base is in electrical contact with the second ground plane 24.

A conductive frame could substitute the dish-shaped conductor cavity 25.

Figure 10:
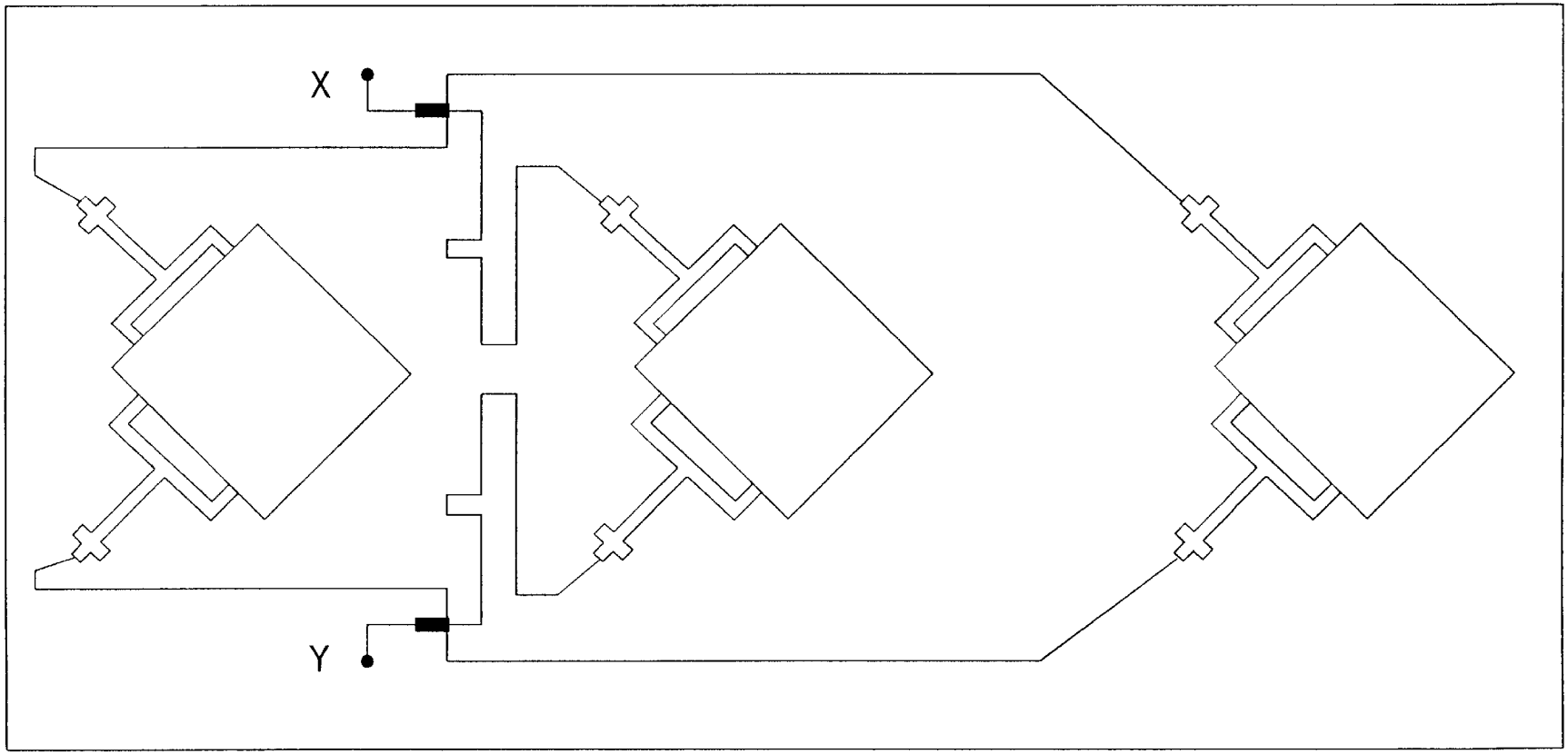
FIG. 10 shows an antenna array comprising a plurality of antenna elements of the present invention.

Referring to FIG. 10, a typical array of these aforementioned elements is shown on a single printed circuit board. The respective sides of each element of the array are fed separate signals. A signal X is fed to the left hand side of each antenna element, similarly a separate signal Y is fed to the right hand side of each antenna element. Therefore the signals are kept at orthogonal polarizations.

The antenna element of the present invention, although primarily used for electronic communications applications, is suitable for use in medical diathermy and microwave heating. A metallic patch of appropriate dimensions could be applied to material to be heated. The patch could be excited by the feed arrangement of the present invention with no physical contact between the patch and the feed arrangement. Such a method may be applied to heating parts of the human body such as by diathermy machine.

Although the invention has been shown and described with respect to a best mode embodiment thereof, it should be understood by those skilled in the art that the foregoing and various other changes, omissions and additions in the form and detail thereof may be made therein without departing from the spirit and scope of the invention.

We claim:

1. An antenna element comprising a planar dielectric element supporting on one side thereof a conductive ground plane element and on an opposite side thereof two substantially identical conductive feed track arrays disposed at right angles to each other and each being electrically symmetric about a bisecting plane, said ground plane element having two substantially identical slot aperture arrangements each comprising at least one elongate slot of predetermined length, the longitudinal axes of said aperture arrangements being disposed at right angles to each other and cross at respective mid-points thereof, each slot aperture arrangement being symmetrical about a respective bisecting plane bisecting a feed track array, a symmetrical conductive patch element disposed in a predetermined spaced relationship with said slot aperture arrangement and above said opposite side of said planar dielectric element, and a symmetrical conductive cavity element comprising a bottom wall portion and at least one side wall portion having a rim, disposed on said ground element and electrically coupled thereto, said cavity element enclosing said slot aperture arrangements within the said wall portions and a surface portion of said ground plane element that is proximate said slot aperture arrangement.

2. An antenna element as claimed in claim 1, wherein each said slot aperture arrangement comprises a single elongate slot.

3. An antenna element as claimed in claim 1, wherein each said slot aperture arrangement comprises two collinear end-loaded slot arrangements.

4. An antenna element as claimed in claim 1, wherein said rim of said cavity element is attached to said ground plane such that it is in electrical contact therewith.

5. An antenna element as claimed claim 1, wherein said rim of said cavity element is attached to said ground plane by adhesive means such that it is capacitively coupled thereto.

6. An antenna as claimed in claim 1, wherein each said feed track array comprises U-shaped array including two limbs joined by a base, said limbs crossing an associated slot aperture at right angles, and an input means extending from said base.

7. An antenna element as claimed in claim 6, wherein each said limb includes open circuit stub means of a predetermined length, that is located proximate said associated slot aperture.

8. An antenna element as claimed in claim 1, wherein said patch element comprises a symmetrical conductive plate having two symmetrical shaped troughs whose longitudinal axes are mutually perpendicular and intersect at mutual mid-points.

9. An antenna element as claimed in claim 8, wherein said troughs face said opposite side of said planar dielectric element.

10. An antenna element as claimed in claim 9, wherein said troughs are rectangular-shaped, V-shaped or hemicyclic-shaped.

11. An antenna element as claimed in claim 8, wherein said troughs are interrupted by a central symmetric aperture.

12. An antenna element as claimed in claim 8, wherein said central symmetric aperture is square-shaped or circular-shaped.

13. An antenna element as claimed in claim 8, wherein said conductive plate is square-shaped or circular-shaped.

14. An antenna element as claimed in claim 1, wherein said planar dielectric element is part of a printed circuit board, said conductive ground plane and said conductive feed track arrays being conductive layers thereon.

15. An antenna element as claimed in claim 1, wherein said patch element forms part of an associated radome element.

16. An antenna array including a plurality of antenna elements as claimed in claim 1, operatively coupled together, and including signal input/output means.

17. An antenna array as claimed in claim 16, wherein said input/output means are located on said opposite side of the planar dielectric element.

18. An antenna element as claimed in claim 1, wherein said antenna element forms a heater element in a diathermy machine.

19. An antenna element comprising a planar dielectric element supporting on one side thereof a first conductive ground plane element and on an opposite side thereof two substantially identical conductive feed track arrays disposed at right angles to each other and each being electrically symmetric about a bisecting plane, said ground plane element having two substantially identical slot aperture arrangements of predetermined length, the longitudinal axes of said aperture arrangements being disposed at right angles to each other and cross at respective mid-points thereof, each slot aperture arrangement being symmetrical about a respective bisecting plane bisecting a feed track array, a symmetrical conductive patch element disposed in a predetermined spaced relationship with said slot aperture arrangement and above said opposite side of said planar dielectric element, a second conductive ground plane supported in a predetermined spaced relationship with said first conductive ground plane, and a symmetrical conductive cavity element comprising a bottom wall portion and at least one side wall portion having a rim, said cavity element being interposed between said first conductive ground plane and said second conductive ground plane, said bottom wall portion electrically contacting said second conductive ground plane and said rim capacitively coupled to said first conductive ground plane, said cavity element enclosing said slot aperture arrangements within the said wall portions and a surface portion of said ground plane element that is proximate said slot aperture arrangement.

20. An antenna element as claimed in claimed in claim 19, wherein said cavity element is circular.

21. An antenna element as claimed in claim 19, wherein each said slot aperture arrangement comprises a single elongate slot.

22. An antenna element as claimed in claim 19, wherein each said slot aperture arrangement comprises two collinear end-loaded slot arrangements.

23. An antenna as claimed in claim 19, wherein each said feed track array comprises U-shaped array including two limbs joined by a base, said limbs crossing an associated slot aperture at right angles, and an input means extending from said base.

24. An antenna element as claimed in claim 19, wherein said patch element comprises a symmetrical conductive plate having two symmetrical shaped troughs whose longitudinal axes are mutually perpendicular and intersect at mutual mid-points.

25. An antenna element as claimed in claim 19, wherein said planar dielectric element is part of a printed circuit board, said first conductive ground plane and said conductive feed track arrays being conductive layers thereon.

26. An antenna element as claimed in claim 19, wherein said patch element forms part of an associated radome element.

27. An antenna array including a plurality of antenna elements as claimed in claim 19, operatively coupled together, and including signal input/output means.

28. An antenna element as claimed in claim 19, wherein said antenna element forms a heater element in a diathermy machine.

* * * * *